US005156528A

United States Patent [19]

Bobo

[11] Patent Number: 5,156,528

[45] Date of Patent: Oct. 20, 1992

[54] VIBRATION DAMPING OF GAS TURBINE ENGINE BUCKETS

[75] Inventor: Melvin Bobo, Cincinnati, Ohio

[73] Assignee: General Electric Company, Cincinnati, Ohio

[21] Appl. No.: 687,646

[22] Filed: Apr. 19, 1991

[51] Int. Cl.[5] ..... B64C 11/16

[52] U.S. Cl. ..... 416/190; 416/500; 416/248; 416/193 A

[58] Field of Search ..... 416/190, 193 A, 248, 416/500

[56] References Cited

U.S. PATENT DOCUMENTS

| | | | |
|---|---|---|---|
| 1,554,614 | 9/1925 | Allen . | |
| 2,310,412 | 2/1943 | Flanders | 253/77 |
| 2,356,605 | 8/1944 | Meininghaus | 416/193 A |
| 3,666,376 | 5/1972 | Damlis | 416/219 |
| 4,101,245 | 7/1978 | Hess et al. | 416/190 |
| 4,111,603 | 9/1978 | Stahl | 416/95 |
| 4,182,598 | 1/1980 | Nelson | 416/193 |
| 4,347,040 | 8/1982 | Jones et al. | 416/190 |
| 4,872,812 | 10/1989 | Hendley et al. | 416/190 |
| 4,917,574 | 4/1990 | Dodd et al. | 416/193 |

FOREIGN PATENT DOCUMENTS

| | | | |
|---|---|---|---|
| 1185415 | 1/1965 | Fed. Rep. of Germany | 416/193 A |
| 2166499 | 7/1974 | Fed. Rep. of Germany | 416/193 A |
| 2265987 | 10/1975 | France | 416/193 A |
| 670665 | 4/1952 | United Kingdom | 416/193 A |
| 2049068 | 12/1980 | United Kingdom | 416/193 A |
| 2112466 | 7/1983 | United Kingdom | 416/193 A |

*Primary Examiner*—Edward K. Look
*Assistant Examiner*—Todd Mattingly
*Attorney, Agent, or Firm*—Jerome C. Squillaro; John R. Rafter

[57] ABSTRACT

A vibration damper is disposed between each adjacent pair of turbine buckets of a gas turbine engine to act in a V-shaped groove defined by bevelled platform surfaces of the adjacent buckets. The damper is wedge-shaped in cross section and is provided with a pad on one side and two pads on another side. When the damper is propelled into the groove by centrifugal force, it assumes a consistent equilibrium position with the raised surface of the one pad slidingly engaging one of the platform bevelled surfaces and the raised surfaces of the other two pads slidingly engaging the other bevelled platform surface to dissipate vibrational energy in the buckets.

8 Claims, 3 Drawing Sheets

VIBRATION DAMPING OF GAS TURBINE ENGINE BUCKETS

The present invention relates to gas turbine engines and particularly to the damping of vibrations induced in turbine blades or buckets.

BACKGROUND OF THE INVENTION

Gas turbine engines include turbine sections comprising a plurality of blades or buckets mounted to the periphery of a rotor wheel or disc in closely, angularly spaced relation. The turbine blades project into the hot gas stream to convert the kinetic energy of this working fluid stream to rotational mechanical energy. To accommodate material growth and shrinkage due to variations in temperature and centrifugal forces, the buckets are typically provided with root sections of a "fir tree" configuration, which are captured in dovetail slots in the rotor disc periphery. During engine operation, vibrations are induced in the turbine buckets. If left unchecked, these vibrations can result in premature fatigue failures in the buckets.

To dissipate the energy of these vibrations and hence lower vibrational amplitude and associated stresses, it is common practice to dispose dampers between adjacent buckets in positions to act against surfaces of tangentially projecting bucket platforms. When the turbine section rotates, the dampers are pressed against the platform surfaces by centrifugal forces. As the buckets vibrate, the damper and platform surfaces slide on each other to produce frictional forces effective in substantially absorbing and thus dissipating much of the vibrational energy.

The vibratory motion of the buckets is complex, but may be considered as composed of two basic modes. One is the tangential mode, wherein the direction of vibration is circumferential, and the angular spacing between adjacent buckets varies. The other is a radial mode, wherein the relative radial positions of adjacent buckets vary. These vibratory modes translate into movements of the platform surfaces of adjacent buckets in phased relation resulting in variations in their angular relationships. It will be appreciated that, for the dampers to be effective, sliding engagements between the damper and platform surfaces must be maintained for both tangential and radial vibrational modes and any combinations thereof.

Vibration dampers of a variety of configurations have been proposed. Flanders U.S. Pat. No. 2,310,412 discloses both circular and wedge-shaped dampers. Circular dampers are also disclosed in Dodd et al. U.S. Pat. No. 4,917,574. Allen U.S. Pat. No. 1,554,614; Stahl U.S. Pat. No. 4,111,603 and Hendley et al. U.S. Pat. No. 4,872,812, also disclose wedge-shaped dampers. T-shaped dampers are disclosed in Hess et al. U.S. Pat. No. 4,101,246; Nelson U.S. Pat. No. 4,182,598 and Jones et al. U.S. Pat. No. 4,347,040. Even X-shaped dampers, as shown in Damlis U.S. Pat. No. 3,666,376.

Of these various vibration damper configurations, the wedge shape is probably more commonly used in current gas turbine engine designs. It is found, however, that the wedge-shaped dampers do not always achieve exact fits with the V-shaped goove-defining platform surfaces of adjacent buckets as their angular relationships vary during bucket vibration and also due to manufacturing tolerances. That is, the dampers rock or become tilted under centrifugal loading, such that one of the damper surfaces lifts off from its confronting platform surface. Consequently, effective energy dissipating sliding action is not achieved with these platform surfaces, leading to premature fatigue failure of the buckets.

SUMMARY OF THE INVENTION

It is accordingly an objective of the present invention to provide an improved damper for dissipating vibrational energy in the buckets or blades of turbine sections of gas turbine engines. The improved vibration damper is uniquely configured such that, under all engine operating conditions, the damper equilibrium position assumed under centrifugal loading assures sliding fits of the damper surfaces with platform surfaces of adjacent buckets, regardless of bucket vibrational mode. As a result, frictional forces are always generated at the damper-platform interfacial surfaces of the adjacent buckets to effectively dissipate a substantial portion of the vibrational energy in both buckets.

To this end, the basic wedge-shaped damper configuration is modified in accordance with the present invention to provide raised pad surfaces on the two sides of the damper normally in surface-to-surface engagement with V-shaped groove-defining, bevelled platform surfaces of adjacent buckets. In the disclosed embodiment, three raised pads are utilized, two on the damper side facing one bevelled platform surface and the third on the damper side facing the other bevelled platform surface. The pads are located on the damper sides such that they do not lift off the bevelled platform surfaces for conditions up to the maximum coefficient of friction characteristic of the particular combination of damper and bucket platform materials, regardless of the vibratory motions of adjacent buckets. By assuring that, for all equilibrium positions of the dampers assumed under centrifugal loading, the reaction forces exerted on the dampers by the platforms do not produce rotating moments, tilting of the damper is prevented. Thus, the damper pads remain in sliding contact with the bevelled platform surfaces to substantially dissipate vibrational energy in the buckets.

The invention thus comprises the features of construction, combination of elements and arrangement of parts all as described hereinafter, and the scope of the invention will be indicated in the claims.

BRIEF DESCRIPTION OF THE DRAWINGS

For a full understanding of the nature and objects of the invention, reference may be had to the following drawing, in which.

Corresponding reference numerals refer to like parts throughout the several views of the drawing.

DETAILED DESCRIPTION

Figure 1:
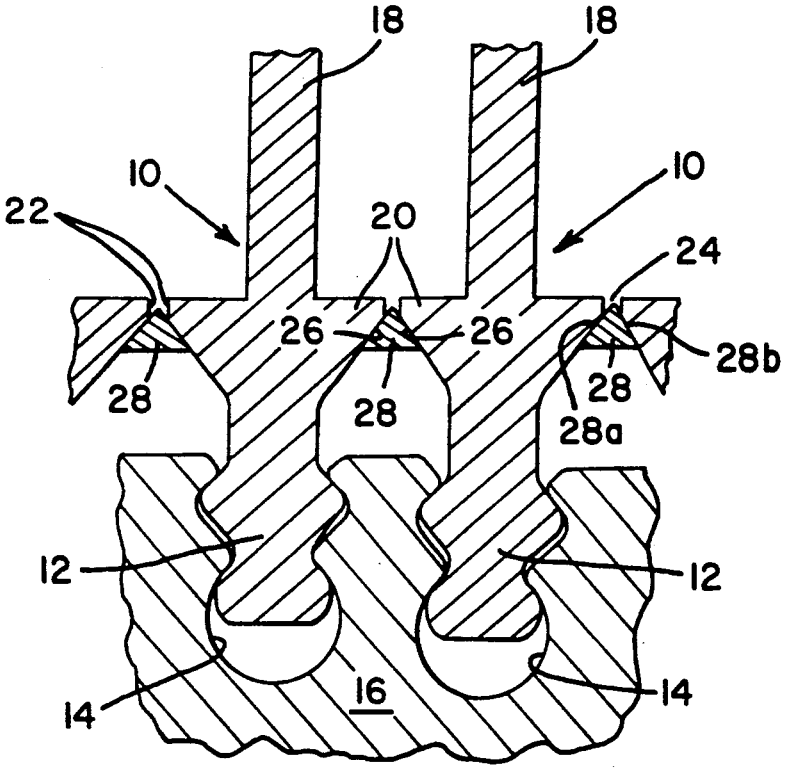
FIG. 1 PRIOR ART
FIG. 1 is a fragmentary sectional view illustrating a conventional turbine bucket to rotor disc mounting arrangement utilizing prior art wedge-shaped vibrating dampers.

Referring to FIG. 1, a turbine section of a gas turbine energy includes an annular array of turbine blades or buckets, generally indicated at 10, including root sections 12 of familiar "fir tree" configuration captured in dovetail slots 14 formed in the periphery of a rotor disk 16 in uniformly angularly spaced relation. Projecting radially from the root sections into the hot gas mainstream of the engine are cambered airfoils 18 for converting the kinetic energy of this working fluid into driven rotation of the rotor disk. Intermediate the root section and airfoil of each bucket are a pair of platforms 20 projecting tangentially in opposite directions. The platforms terminate at radial edge surfaces 22 which define gaps 24 between platforms of adjacent pairs of buckets to accommodate thermal expansion. The platforms beneficially serve as shroud sections defining the radially inner boundary of the hot gas stream flowing axially through the turbine section.

The platforms are undercut at oblique angles to provide bevelled surfaces 26, with the bevelled surfaces of confronting shoulders defining axially extending V-shaped grooves. Loosely captured in positions radially underlying each V-shaped groove are conventional, axially elongated vibration dampers 28 of triangular or wedge-shaped cross section. During rotation of the rotor disk, the dampers are propelled radially outward by centrifugal forces into these grooves, causing their radially outwardly facing surfaces 28*a* and 28*b* to frictionally engage the bevelled platform surfaces 26. Consequently, when the buckets undergo vibration, the platform surfaces 26 slide relative to the damper surfaces 28*a*, 28*b*, generating frictional forces to dissipate the vibrational energy in the buckets. Since the dampers operate adjacent the root sections of the buckets where vibratory amplitude is small, typically less than one mil, as compared to amplitudes adjacent the bucket tips, it is imperitive that effective sliding contact between the dampers and the platform surfaces be maintained, regardless of vibratory mode.

As disclosed in the commonly assigned Hendley et al. U.S. Pat. No. 4,872,812, wedge-shaped dampers, since they can effectively close off gaps 24, also serve to seal the radially inner boundary of the hot gas stream. Leakage of hot gases into the area inwardly of platforms and loss of cooling air out into the hot gas mainstream are discouraged.

Figure 2A:
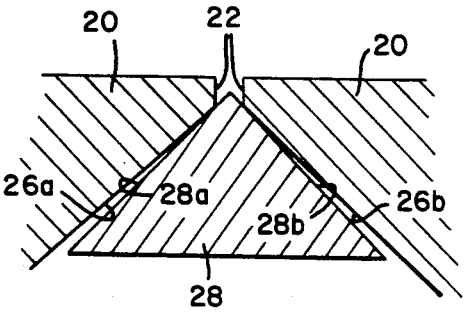
FIGS. 2*a* and 2*b* are exaggerated illustrations of two possible inexact fits between the platform surfaces of adjacent buckets and a prior art damper of FIG. 1.

For a wedge-shaped damper 28 to exactly fit the V-shaped groove defined by platform surfaces 26, i.e., with full surface interfacial contact, the damper and platforms must be precisely machined such that the bevelled surfaces subtend an angle equal to the angle between the confronting damper sides. FIG. 2*a* illustrates in extreme exaggeration a damper fit condition wherein the angle subtended by bevelled platform surfaces 26*a* and 26*b* is greater than the angle between confronting damper sides 28*a* and 28*b*. Assuming no bucket vibration, damper 28 can assume a position under centrifugal load, wherein the damper sides 28*a* and 28*b* contact platforms 20 essentially along axial lines at the junctions of platform surfaces 26*a* and 26*b* with radial edge surfaces 22.

Figure 2B:
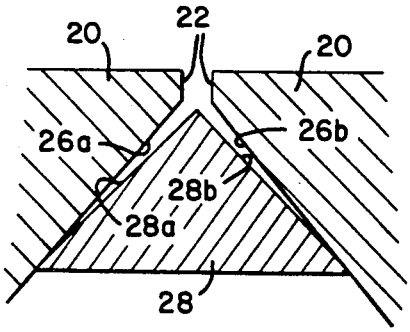

FIG. 2*b* illustrates the opposite situation, wherein the angle subtended by platform surfaces 26*a* and 26*b* is less than the angle between damper sides 28*a* and 28*b*. Again assuming no bucket vibration, the damper can assume a centrifugally loaded position, wherein the damper engages the platform surfaces along lines of contact at the axially extending lower edges of sides 28*a* and 28*b*.

It will be appreciated that the fit conditions illustrated in FIGS. 2*a* and 2*b* are also affected by a tangential mode of vibration, when the buckets 18 flex back and forth in the circumferential direction in the manner of cantilever mounted beams. This bucket vibratory motion is reflected in oscillatory motions of the platform surfaces 26 of adjacent buckets, which generally rise and fall in some phased relation. That is, one platform surface may be rising, i.e. moving generally radially outward, while the other platform surface of a V-shaped groove is falling in some out-of-phase relation. It is seen that such platform surface relative motions will result in variations in their subtended angle and thus changes in the fit of the damper in the V-shaped groove.

Figure 3A:
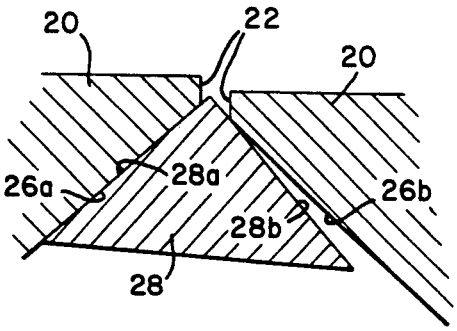
FIGS. 3*a* and 3*b* are exaggerated illustrations of damper equilibrium positions assumed under radial mode bucket vibration for the fit conditions illustrated in FIGS. 2*a* and 2*b*.

If, for the fit condition illustrated in FIG. 2*a*, the buckets undergo vibration in the radial mode, when the left platform is moving radially outward relative to the right platform, damper 28 is forced to rotate or rock in the clockwise direction to the tilted equilibrium position illustrated in FIG. 3*a*. Damper side 28*a* assumes full surface contact with platform bevelled surface 26*a*, while damper side 28*b* continues to contact the right platform essentially along the junction between platform surface 26*b* and radial edge surface 22. When the relative radial motion of the buckets reverse, the damper can rock in the clockwise direction with damper side 26*a* lifting off from platform surface 26*a* and damper side 28*b* swinging into full surface contact with platform surface 26*b*. It will be appreciated that, this rocking motion of the damper significantly diminishes the extent of sliding motion between the damper and platforms. Consequently, the efficacy of the damper in dissipating vibrational energy in the buckets is severly prejudiced.

Figure 3B:
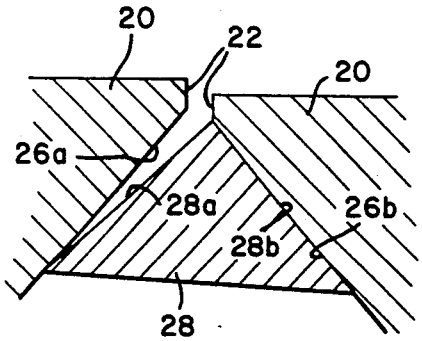

The same damper liftoff situation exists for the fit condition of FIG. 2*b*. FIG. 3*b* illustrates the situation for this fit condition when the left platform 20 is rising relative to the right platform. Damper 28 rocks in the clockwise direction to assume an equilibrium position with its side 28*b* flush against platform surface 26*b*, while only the lower edge of side 28*a* contacts platform surface 26*a*. Then when the right platform is rising relative to the left platform, the damper can rock in the counterclockwise direction such that its side 28*a* assumes full surface contact with platform surface 26*a* and side 28*b* lifts off from full surface to line contact with platform surface 26*b*. Again, such rocking damper motion does not produce friction forces at the platform surfaces necessary to dissipate vibrational energy in the buckets.

Figure 4A:
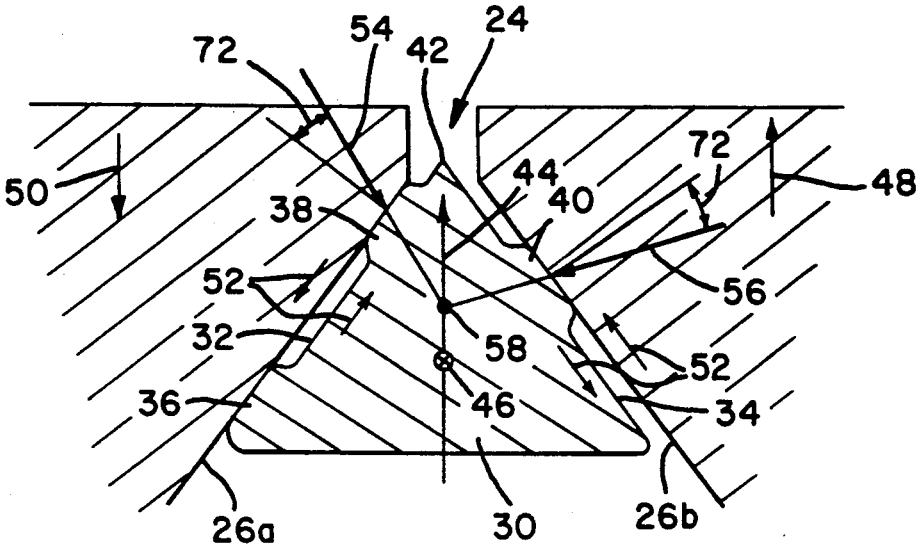
FIGS. 4*a* and 4*b* are fragmentary sectional views of a vibration damper constructed pursuant to the present invention and illustrating damper equilibrium positions under different vibratory conditions of adjacent turbine buckets.
Figure 4B:
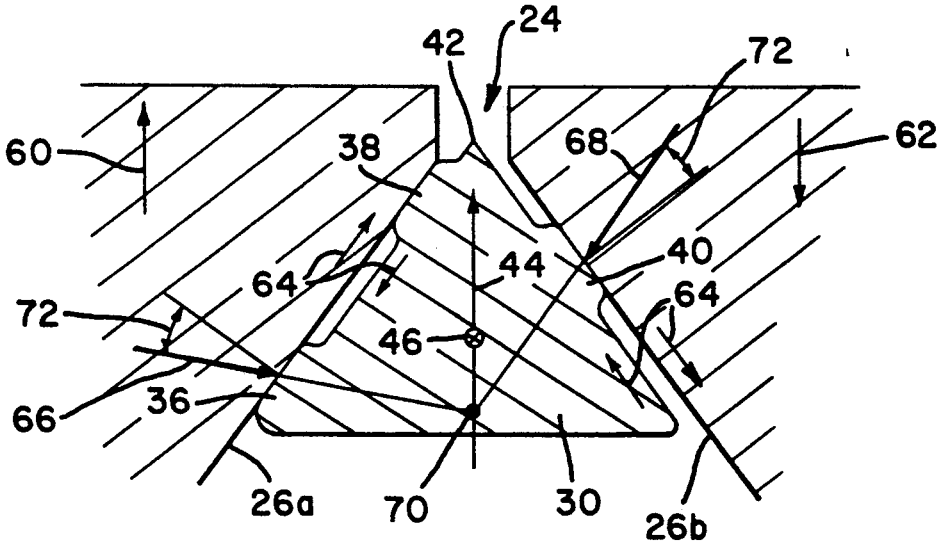

To preclude damper rocking motion in accordance with the present invention, a triangular or wedge-shaped damper, generally indicated at 30 in FIGS. 4*a* and 4*b*, is provided with a plurality of raised pad surfaces outstanding from its two radially outwardly facing sides 32 and 34. In the illustrated embodiment, two pads 36 and 38 are formed on damper side 32 and a single pad 40 on side 34. Pad 36 is located proximate the radially inner end of damper side 32, while pad 38 is located on side 32 at a position proximate the damper apex 42. Pad 40 is located on damper side 34 at an appropriate position between apex 42 and the side inner end. It will be appreciated that the illustrated pad positions may be swapped between damper sides 32 and 34.

During rotation of the rotor disc, the centrifugal force on damper 30 (vector 44 acting radially through the damper center of gravity 46) propels the damper radially outwardly into the V-shaped groove with pads 36, 38 and 40 bearing against their confronting platform surfaces 26. For the vibratory condition illustrated in FIG. 3*a*, platform surface 26*b* is rising (arrow 48) relative to platform surface 26*b* (arrow 50), and the relative sliding motions of the damper and platform surfaces are indicated by arrows 52. The equilibrium position of damper 30 is established when the centrifugal force on the damper is balanced by the reaction forces exerted on the pads by the platforms. For the relative bucket motion indicated by arrows 48, 50 and a condition of maximum coefficient of friction, the damper equilibrium position is established by the loads exerted on pads 38 and 40 balancing the damper centrifugal load (vector 44), with the load on pad 36 dropping to essentially zero. As long as the load on pad 38, represented by arrow 54, and the load on pad 40, represented by arrow 56, are directed at a common point 58 on the line of action of centrifugal loading, vector 44, there is no rotational moment acting on the damper that would result in a tilted or rocked equilibrium position. Thus the pads always remain in sliding contact with the platform surfaces, i.e. no lift off.

FIG. 4*b* illustrates the reverse condition, i.e. platform surface 26*a* rising (arrow 60) relative to platform surface 26*b* (arrow 62), with the relative sliding motions of the damper and platform surfaces indicated by arrows 64. Again for the condition of maximum coefficient of friction, the equilibrium position of damper 30 is established by the damper centrifugal force balancing loads exerted on pads 36 and 40; the load on pad 38 then being essentially zero. It is seen that the load on pad 36 (arrow 66) and the load on pad 40 (arrow 68) are also directed to a common point 70 on the centrifugal force line to avoid a rocking moment on damper 30. Thus, pads 36, 38 and 40 remain in sliding contact with the platform surfaces to substantially dissipate the vibrational energy in the buckets.

It should be pointed out that the balancing loads on the pads will not consistently be normal to the pad surfaces. For the relative platform motion illustrated in FIG. 4*a*, wherein the balancing loads are exerted only on pads 38 and 40, the loading forces, indicated by arrows 54 and 56, are off normal by angles 72 whose arctangent is equal to the maximum coefficient of friction. The same is true of the pad loading forces 66 and 68 in FIG. 4*b*. The sides to which the pad loading force is off normal depends on the directions of relative sliding motion between the pads and platform surfaces.

To establish the positions of the pads on the damper sides, the first step is to determine mathematically or experimentally that the coefficient of friction of the materials used in the dampers and bucket platforms will equal or exceed the maximum value expected in a particular situation. A suitable damper material may be a high strength, high temperature cobalt alloy with good lubricity, while the bucket platform may be a high strength, high temperature nickel alloy. The position of pad 38 is then set at a location proximate, but sufficiently removed from apex 42 so it will not move appreciably out into gap 24 at its maximum width.

The position of pad 40 is then established for the conditions of FIG. 4*a*, such that the line of action of loading force 56, acting on the pad midpoint, intersects the line of action of loading force 54, acting on the midpoint of pad 38, at point 58 on the line of action of centrifugal force 44. Then, pad 36 is positioned for the conditions of FIG. 4*b*, such that force 66, acting at its midpoint, and loading force 68, acting at the midpoint of pad 40, are both directed at point 70 on the centrifugal force line of action. The three pads are then positioned such as to preclude rotating or rocking moments on the pads for conditions of maximum coefficient of friction under the extreme situations illustrated in FIGS. 4*a* and 4*b*.

It is thus seen that the present invention provides a vibration damper which, by virtue of the illustrated pad arrangement, is capable of assuming a stable three-point stance (in the manner of a three legged stool) in continuous sliding contact with the platform surfaces despite manufacturing mismatches in the V-shaped groove and damper angles and vibration-induced variations in the V-shaped groove geometry.

Since damper rocking motion and surface liftoff are avoided, full advantage of the minute surface sliding motions available at the damper-platform interfaces is taken to dissipate vibrational energy in the turbine buckets.

From the foregoing Detailed Description it is seen that the objectives of the present invention are efficiently attained, and, since changes may be made in the construction set forth without departing from the scope of the invention, it is intended that matters of detail be taken as illustrative and not in a limiting sense.

Having described the invention, what is claimed as new and desired to secure by letters patent is:

1. A vibration damper for acting in a V-shaped groove defined by first and second bevelled surfaces of an adjacent pair of turbine buckets mounted to a rotor disc of a gas turbine engine, said damper comprising, in combination:

A. a body;

B. a first pad carried by said body and having a first raised surface in confronting relation with the first bevelled surface;

C. a second pad carried by said body and having a second raised surface in confronting relation with the second bevelled surface; and D. A third pad carried by said body and having a third raised surface in confronting relation with said second bevelled surface;

E. whereby, upon rotation of the rotor disc, said damper is propelled into the V-shaped groove by centrifugal force to press said first raised surface into sliding engagement with the first bevelled surface and to press said second and third raised surfaces into sliding engagement with the second bevelled surface, thereby to dissipate vibrational energy in the adjacent pair of turbine buckets; and F. wherein said body is wedge-shaped having a first side on which said first pad is formed and a second side on which said second and third pads are formed; and G. wherein the dimensions of said first, second and third raised surfaces are significantly less than the dimensions of said first and second body sides, such that said damper can assume a consistently stable, essentially three-point stance in the V-shaped groove for all vibratory modes of the adjacent pair of turbine buckets; and H. wherein the locations of said first pad on said first body side and said second and third pads on said second body side are such that the loading forces on said pads at the first and second bevelled surfaces do not produce rotational moments on said damper.

2. The damper defined in claim 1, wherein the locations of said pads on said body sides are established to preclude rotational moments on said damper under conditions of maximum coefficient of friction when the loading force on one of the second and third pads falls to essentially zero.

3. A vibration damper for acting in a V-shaped groove defined by first and second bevelled surfaces of an adjacent pair of turbine buckets mounted to a rotor disc of a gas turbine engine, said damper comprising, in combination:

A. a body having a system for contacting said first and second bevelled surfaces, said system consisting of first, second, and third pads;

B. said first pad carried by said body and having a first raised surface in confronting relation with the first bevelled surface;

C. said second pad carried by said body and having a second raised surface in confronting relation with the second bevelled surface; and D. said third pad carried by said body and having a third raised surface in confronting relation with said second bevelled surface; and E. whereby, upon rotation of the rotor disc, said damper is propelled into the V-shaped groove by centrifugal force to press said first raised surface into sliding engagement with the first bevelled surface and to press said second and third raised surfaces into sliding engagement with the second bevelled surface, thereby to dissipate vibrational energy in the adjacent pair of turbine buckets.

4. The damper defined in claim 3, wherein said body is wedge-shaped having a first side on which said first pad is formed and a second side on which said second and third pads are formed.

5. The damper defined in claim 4, wherein the dimensions of said first, second and third raised surfaces are significantly less than the dimensions of said first and second body sides, such that said damper can assume a consistently stable, essentially three-point stance in the V-shaped groove for all vibratory modes of the adjacent pair of turbine buckets.

6. The damper defined in claim 5, wherein the first and second bevelled surfaces are respectively formed on tangentially extending platforms of the adjacent pair of turbine buckets.

7. The damper defined in claim 5, wherein the locations of said first pad on said first body side and said second and third pads on said second body side are such that the loading forces on said pads at the first and second bevelled surfaces do not produce rotational moments on said damper.

8. The damper defined in claim 7, wherein the locations of said pads on said body sides are established to preclude rotational moments on said damper under conditions of maximum coefficient of friction when the loading force on one of the second and third pads falls to essentially zero.

* * * * *